United States Patent [19]

Tolley

[11] 4,172,878

[45] Oct. 30, 1979

[54] RECOVERY OF TITANIUM METAL VALUES

[75] Inventor: William K. Tolley, Arlington Heights, Ill.

[73] Assignee: UOP Inc., Des Plaines, Ill.

[21] Appl. No.: 926,980

[22] Filed: Jul. 21, 1978

[51] Int. Cl.[2] ..... C01G 23/04

[52] U.S. Cl. ..... 423/83; 423/82; 423/86; 423/140; 423/150; 75/114

[58] Field of Search ..... 423/82, 83, 85, 86; 75/1 T, 101 R, 114, 11

[56] References Cited

U.S. PATENT DOCUMENTS

| | | | |
|---|---|---|---|
| 3,076,692 | 2/1963 | Ruter et al. | 423/83 |
| 3,236,596 | 2/1966 | Zingibl et al. | 423/83 |
| 3,407,033 | 10/1968 | Ruter et al. | 423/83 |
| 3,825,419 | 7/1974 | Chen | 75/101 R |
| 3,859,077 | 1/1975 | Othmer | 75/1 T |
| 3,903,239 | 9/1975 | Berkovich | 423/82 |
| 3,929,962 | 12/1975 | Shiah | 423/83 |

*Primary Examiner*—Herbert T. Carter
*Attorney, Agent, or Firm*—James R. Hoatson, Jr.; Raymond H. Nelson; William H. Page, II

[57] ABSTRACT

Titanium metal values may be recovered from a titanium bearing source such as an ilmenite ore by subjecting the source to a reductive roast, leaching the reduced source with a halogen-containing compound followed by crystallization of the iron halide impurity which is separated from the soluble titanium halide. The soluble titanium halide is then treated with an iron oxide to form titanium dioxide. The yield of titanium dioxide may be greatly improved by effecting the nucleation of the titanium in a manner which comprises adding the iron oxide to the solution without agitation. Upon completion of the nucleation reaction, the solids are then thoroughly dispersed before removing the solid titanium dioxide.

6 Claims, No Drawings

RECOVERY OF TITANIUM METAL VALUES

BACKGROUND OF THE INVENTION

Titanium in metallic form or as a compound is an important element in the chemical series. For example, titanium dioxide is utilized in paint pigments, in white rubbers and plastics, floor coverings, glassware and ceramics, painting inks, as an opacifying agent in papers, etc. The other titanium compounds are used in electronics, as fire retardants, waterproofing agents, etc. The metal may be used as such or in alloy form as structural material in aircraft, in jet engines, marine equipment, textile machinery, surgical instruments, orthopedic appliances, sporting equipment, food handling equipment, etc. Heretofore in recovering the titanium from titanium bearing sources such as ilmenite, rutile, etc., the titanium has been subjected to separation steps which involve the formation of titanium as a compound in a valence state of +4, such compounds usually involving titanium oxide. However, when attempting to separate titanium dioxide from impurities which are also contained in the ore such as iron, the hydrolysis of the titanium dioxide at elevated temperatures usually results in also obtaining relatively large amounts of iron along with the titanium.

Heretofore in the prior art various methods have been utilized to recover titanium values from titanium bearing sources. For example, in U.S. Pat. No. 3,236,596 an unroasted ilmenite ore is leached with hydrogen chloride at an elevated temperature. Following this, dissolved iron is reduced with iron or other reductants to precipitate ferrous chloride by saturating the liquor with hydrogen chloride gas. The hydrogen chloride is then extracted from the liquor by a vacuum distillation and the titanium is recovered by conventional means. Likewise, U.S. Pat. No. 3,825,419 reduces an ilmenite ore to produce ferrous oxides. The reduced ore is then leached for about 4 hours under a moderate pressure thereby dissolving the iron in the acid along with about 15% of the titanium. The iron is recovered as ferric oxide containing impurities in the spray roaster while the insoluble product which is primarily titanium dioxide but which contains all of the silica present in the original ore is recovered. U.S. Pat. No. 3,859,077 also discloses a process for recovering titanium in which a titanium tetrahalide is mixed with iron oxide in slag or a titaniferous ore at an extremely high temperature of about 1000° C. to produce volatile impurity chlorides and titanium dioxide. A similar patent, U.S. Pat. No. 3,929,962, also reduces a titanium bearing ore at a high temperature to produce titanium sesquioxide which is in a form whereby it is easier to treat for a titanium-iron separation. Another prior art reference, U.S. Pat. No. 3,903,239 teaches a method for recovering titanium in which unroasted ilmenite is leached over a period of days at room temperature to recover about 80% of the titanium. Sulfur dioxide is added during the leaching to cause a precipitation of the ferrous chloride after which titanium dioxide is recovered by diluting and heating the solution.

As will hereinafter be shown in greater detail, it has now been discovered that improved yields of titanium dioxide may be obtained by treating titanium halides in a preferred manner.

This invention relates to a process for obtaining excellent yields of titanium compounds such as titanium dioxide. More specifically, the invention is concerned with a process for recovering economical yields of titanium metal values from a titanium bearing source such as ilmenite. By utilizing the process of the present invention, it will be possible to obtain an excellent yield of titanium metal values using relatively low grade ores as the starting material.

It is therefore an object of this invention to provide an improved process for the production of titanium metal values.

A further object of this invention is to provide a hydrometallurgical process for obtaining high yields of titanium metal values in the form of rutile from titanium bearing sources such as ilmenite.

In one aspect an embodiment of this invention resides in a process for producing titanium metal values from a titanium bearing source which comprises the steps of crushing said titanium bearing source, subjecting said crushed source to a reductive roast at an elevated temperature in a reducing medium, leaching the reduced source with a leach solution comprising a halogen-containing compound, separating insoluble material from the pregnant leach liquor, cooling said leach liquor to precipitate iron halides and separating the resultant solid iron halides from the leach liquor, precipitating titanium dioxide from said leach liquor, and recovering the solid titanium dioxide.

A specific embodiment of this invention resides in a process for producing titanium metal values from ilmenite which comprises crushing said ilmenite to a desired particle size, subjecting the crushed ilmenite to a reductive roast at a temperature in the range of from about 600° to about 1000° C. in a reducing medium comprising carbon monoxide and hydrogen, leaching the reduced source with an aqueous hydrogen chloride solution, separating insoluble material from the pregnant leach liquor, cooling said leach liquor to precipitate iron chloride and separating the iron chloride from the leach liquor, treating the leach liquor by the addition of ferric oxide at a temperature in a range of from about 70° to about 100° C. in the absence of any agitation and thereafter agitating the mixture of leach liquor and iron oxides for a further period of time whereby the solids are maintained in a suspended state following which titanium dioxide is recovered.

Other objects and embodiments will be found in the following further detailed description of the present invention.

As hereinbefore set forth the present invention is concerned with a process for preparing readily obtainable rutile from a leach liquor containing soluble titanium halides. The process for obtaining the desired titanium metal values is effected by crushing an ore source such as ilmenite or other sources such as sand which contains the desired metals, chiefly titanium, as well as amounts of other metals such as iron, vanadium, chromium, manganese, etc., to a particle size which is less than about −100 mesh. Thereafter the crushed metal bearing source is subjected to a reductive roast at an elevated temperature which will range from about 600° to about 1000° C. or more and preferably in a range of from about 600° to about 900° C. in the presence of a reducing gas such as hydrogen, carbon monoxide, combinations of carbon monoxide and hydrogen, etc., or any other suitable reductant. The reductive roast is effected for a period of time ranging from about 0.5 up to about 2 hours or more. In the preferred embodiment of the invention, the reducing atmosphere which is used to accomplish the purpose of the roast usually comprises a mixture of about 50% carbon monoxide and 50% hydrogen, with an excess of reductant being utilized in order to completely reduce the iron which is present in the system to the metal. It is also contemplated within the scope of this invention that the crushed ore may be, if so desired, subjected to an oxidation roast prior to the reductive roast, said oxidative roast being accomplished at a temperature in the range of from about 600° to about 900° C. in the presence of an oxidizing atmosphere which is provided for by the presence of air or oxygen. However, it is to be understood that this step is not a necessary part of the present invention. Following the reductive roast of the metal bearing source, the source is then subjected to an aqueous hydrogen halide leach which, in the preferred embodiment of the invention, comprises an aqueous hydrogen chloride leach although other hydrogen halides such as hydrogen bromide and hydrogen iodide may also be utilized although not necessarily with equivalent results. The aforesaid leach of the metal bearing source is usually effected at a temperature which may range from about ambient up to about 110° C., the preferred range being from about 80° to about 100° C., for a period of time ranging from about 0.25 hours up to about 1 hour or more in duration.

Following the leach of the metal bearing source which will form soluble iron halides and titanium halides such as ferrous chloride, titanium trichloride, etc., the mixture is subjected to a separation step in which the solid gangue is separated from the soluble metal chlorides and discarded. The separation of the solid gangue from the soluble metal chlorides may be effected in any suitable manner by means well known in the art, said means including decantation, filtration, etc. The soluble metal halides are then cooled to a temperature sufficient to effect a crystallization or precipitation of the ferrous chloride. For example, the temperature at which the crystallization or precipitation of the ferrous chloride is effected may range from about 0° to slightly in excess of ambient or up to 90° C. in extreme cases. When utilizing subambient temperatures, the cooled solution is maintained in the subambient range by external means such as an ice bath, cooling coils, etc. After crystallization of the ferrous chloride is completed, the solids are separated from the aqueous titanium trichloride by conventional means such as filtration, decantation, etc.

The desired titanium dioxide in the form of rutile is obtained by treating the leach solution containing aqueous titanium trichloride with a metal oxide and preferably an iron oxide such as ferric oxide. The latter compound may be obtained by oxidizing the solid ferrous chloride which has been separated and recovered from the leach solution in any manner known in the art. For example, the ferrous chloride may be oxidized at temperatures ranging from about 300° to 800° C. in contact with an oxygen-containing gas such as air whereby the ferrous chloride is converted to ferrous oxide and ferric oxide, the latter compound being the predominant form of the iron oxide. The treatment of the leach solution containing titanium trichloride is effected by adding the iron oxide material to the leach solution in the absence of any agitation. The solids are then allowed to react for a period which may range from about 0.5 to about 5 minutes or more in duration during which time nucleation is effected with the concomitant formation of titanium dioxide. The reaction of the iron oxide with the titanium compound is effected at elevated temperatures which may range from about 70° to 100° C. or more and preferably in a range of from 75° to 95° C., said iron oxide being present in the reaction mixture in an amount in the range of from about 2.0 times to about 3.5 times by weight of the titanium which is present in the leach liquor. Upon completion of the nucleation period, the solids are then brought into suspension by agitating the solution so that the solids are thoroughly dispersed in the reaction medium and after another period of time which may range from about 3 to about 30 minutes or more while continuing the agitation the reaction is complete. Thereafter, the titanium dioxide which is in solid form may be separated from the barren leach liquor, washed, dried and recovered as such or, if so desired, the titanium dioxide may be further treated to recover titanium metal.

Alternatively, the desired titanium dioxide may be recovered, utilizing the process of the present invention, by leaching the crushed ilmenite in a manner similar to that hereinbefore set forth and thereafter subjecting the leach solution to a separation step whereby the insoluble materials such as gangue are separated from the solution. After separation to remove the tails the leach solution is then treated in a manner hereinbefore set forth by the addition of iron oxides, particularly ferric oxide by adding the material to the leach solution in the absence of any agitation. After allowing the solids to react for a predetermined period of time to effect nucleation the solids are again brought into suspension and the titanium dioxide in solid form is separated from the leach liquor which will contain the iron chlorides formed during the leaching and nucleation periods.

The soluble ferrous chloride in the leach liquor may then be precipitated by cooling the liquor to form solid ferrous chloride. Thereafter, the ferrous chloride may then be treated in either a reduction step or an oxidation step. If the former step is effected, that is, the direct reduction of ferrous chloride the resulting iron metal may be recovered while any hydrogen chloride which is formed may be recycled to the leach liquor. If the ferrous chloride is subjected to an oxidation step, the ferric oxide which is formed during the reaction may be recycled to the titanium dioxide recovery step, said ferric oxide acting as the nucleate reagent.

The process of the present invention may be effected in any suitable manner and may comprise either a batch or continuous type operation. For example, when a batch type operation is to be employed, the titanium bearing source which has been crushed to the desired particle size is placed in an apparatus such as an oven wherein it is roasted at a temperature within the range hereinbefore set forth while subjecting the ore to a reducing atmosphere which, as hereinbefore set forth, may comprise a mixture of carbon monoxide and hydrogen. Upon completion of the reductive roast the crushed ore is then placed in a second vessel wherein it is leached by contact with an aqueous hydrogen halide such as concentrated hydrochloric acid while maintaining the temperature in a range of from about 80° to 105° C. Upon completion of the desired leach the solid material such as gangue and/or insoluble metal compounds are separated from the pregnant leach liquor which is recovered and placed in a flask or such which is then cooled or is maintained at a relatively cool temperature in order to crystallize out the ferrous chloride. After precipitation of the ferrous chloride and leach liquor containing the soluble titanium chloride is separated from the solid ferrous chloride by conventional means such as filtration and placed in yet another apparatus where it is contacted with ferric oxide. This apparatus will contain heating means as well as agitation means whereby after passage of the nucleation period the mixture may be agitated by means of mechanical stirrers or other agitation. Upon completion of the desired reaction and with the attendant formation of titanium dioxide, solid titanium dioxide is separated from the barren leach liquor and recovered.

In addition, it is also contemplated within the scope of this invention that a continuous manner of operation to obtain titanium dioxide may be employed. When such a type of operation is used, the crushed ore in the desired particle size is passed through an apparatus such as an oven at a predetermined rate of speed while being subjected to a reducing atmosphere, meanwhile maintaining the temperature of the oven in a range of from about 600° to about 1000° C. After completing the passage through the oven the reduced ore is continuously charged to a leaching zone wherein it is contacted with an aqueous leach solution comprising hydrogen chloride and after passage through the leaching zone the solution containing the soluble iron chlorides and titanium chlorides is separated from the solid gangue material. Pregnant leach liquor is then continuously charged to a crystallization zone which is maintained at a lower temperature to facilitate the precipitation or crystallization of the ferrous chloride. The leach liquor containing the soluble titanium dichloride is continuously withdrawn from this zone and passed to a precipitation zone wherein it is contacted with ferric oxide first in a state wherein no agitation is present and thereafter passage into a second zone where it is agitated. The ferrous chloride which has been separated from the pregnant leach liquid containing the soluble titanium chloride may, if so desired, be passed to an oxidation zone where it is contacted with oxygen-containing gas at an elevated temperature in the range of from about 300° to 800° C. to form ferric oxide, this compound then being used to treat the leach liquor containing the soluble titanium chloride while the hydrogen chloride which is formed during the oxidation reaction is recycled to the leach zone to form a portion of the leaching solution charge stock. After passage through the agitation zone of the precipitation step, the solution is withdrawn and the solid titanium dioxide is separated from the leach and recovered.

The following examples are given for purposes of illustrating the process of this invention. However, it is to be understood that these examples are given merely for purposes of illustration and that the present process is not necessarily limited thereto.

EXAMPLE I

An ilmenite ore was coarsely ground in a crusher to −65 mesh following which 200 grams was roasted for a period of one hour at 750° C. under a flow of 640 ml/min. each of hydrogen and carbon monoxide. At the end of the roasting time, 50 grams of the reduced material was mixed with 300 cc of hydrochloric acid and heated to a temperature of 100° C. The solids were leached at this temperature for a period of 15 minutes and thereafter were filtered. After filtration the filtrate was cooled to room temperature to precipitate ferrous chloride. The ferrous chloride crystals were separated from the solution by filtration, 240 ml of liquid being recovered. Analysis of this liquid disclosed the presence of 25 grams/liter of iron, 39 grams/liter of titanium and about 0.43 grams/liter of vanadium.

The solution recovered from the above paragraph in the amount of 100 cc was heated to 85° C. and 12.3 grams of ferric oxide were quickly added without agitation. The solution was allowed to stand for a period of 1 minute following which agitation was commenced and allowed to continue for a period of 4 minutes. At the end of this time the solids which formed during the agitation were filtered, washed and dried. The solid rutile which was recovered consisted of 7.15 grams containing 1.2% iron, 0.021% magnesium and 0.11% cobalt, the remaining portion being titanium dioxide. This amounted to a 97% recovery of the titanium.

EXAMPLE II

To illustrate the contrast when not utilizing the process of the present invention, 66.7 grams of a reduced ilmenite ore possessing a particle size of −65 mesh after having been reduced by treatment with a mixture of carbon monoxide and hydrogen at a temperature of 750° C. was admixed with 400 cc of hydrochloric acid and heated to 100° C. The solids were leached for a period of 15 minutes at this temperature following which the solids were filtered, washed and dried. The filtrate which was recovered from the filtration step was cooled to room temperature to crystallize the ferrous chloride. After crystallization the solids were filtered to separate them from the filtrate, 293 cc of solution being recovered which contained 23 grams/liter of iron, 49 grams/liter of titanium and 0.43 grams/liter of vanadium. In an attempt to recover titanium 100 cc of the solution was heated to a temperature of 80° C. Following this 6.4 grams of ferric oxide was added with agitation and the solution was agitated for a period of 5 minutes. At the end of this period, the ferric oxide had dissolved completely but no titanium dioxide precipitated out. In a second experiment, the solution was heated to 80° C. and 9.6 grams of iron oxide was added. The addition of the iron oxide was effected under agitation which was continued for 5 minutes. At the end of this period the iron oxide had again dissolved and only approximately 0.01 grams of a solid was recovered. When the above experiment was repeated using 12 grams of iron oxide which was added under agitated circumstances, no titanium dioxide was recovered.

It is, therefore, readily apparent from a comparison of the two examples that when utilizing the process of the present invention, that is, by adding ferric oxide to a leach solution in the absence of any agitation and after the nucleation period has elapsed agitating the solution to form a suspension of the solids, it is possible to obtain a high yield of the desired product, namely, titanium dioxide.

EXAMPLE III

As a further illustration of the process of the present invention, 50 grams of Canadian ilmenite which has been reduced in a manner similar to that hereinbefore set forth was admixed with 300 ml of hydrochloric acid and thereafter was heated to 100° C. The leach was continued for a period of 30 minutes following which the solution was filtered to remove the solids. The solution which was recovered was analyzed and found to contain 65 grams/liter of iron and 35 grams/liter of titanium. In an attempt to recover the titanium, 100 ml of the solution was heated to 90° C. and 12.0 grams of ferric oxide was added with agitation. The solution was then heated to 105° C. and allowed to react for a period of 5 minutes. At the end of this period no significant amount of solid had precipitated, there being too little solid to measure.

Thus, it is shown that when ferric oxide is added to a solution containing soluble titanium chloride with agitation it is not possible to obtain the desired formation and precipitation of titanium dioxide, the desired effect being obtained by adding the precipitating agent, namely, ferric oxide, and in the absence of any agitation.

I claim as my invention:

1. In a process for producing titanium metal values from a titanium bearing source which comprises the steps of;

(a) crushing said titanium bearing source;

(b) subjecting said crushed source to a reductive roast at an elevated temperature in a reducing medium;

(c) leaching the reduced source with a leach solution comprising a hydrogen halide;

(d) separating insoluble material from the pregnant leach liquor; and (e) cooling said leach liquor to precipitate iron halides and separating the resultant solid iron halides from the leach liquor; the improvement which comprises the steps of:

(1) adding solid ferric oxide in the amount of about 2 to 3.5 times by weight of titanium present to said leach liquor after separation of the solid iron halides therefrom and reacting the same at temperatures of about 70° to about 100° C., without agitation, for a sufficient time to effect nucleation with concomitant formation of titanium dioxide;

(2) upon completion of said nucleation, agitating the reaction mixture to bring the solids into suspension and continuing the agitation until the reaction of the ferric oxide with the titanium compound is completed, thereby precipitating titanium dioxide; and (3) recovering the solid titanium dioxide thus formed.

2. The process as set forth in claim 1 in which the nucleation reaction is effected in a period of time ranging from about 0.5 to about 5 minutes.

3. The improvement as set forth in claim 2 in which said reaction mixture is agitated in step (2) for a period of from about 3 to about 30 minutes.

4. The process as set forth in claim 1 in which the reductive roast is effected at a temperature in the range of from about 600° to about 1000° C.

5. The process as set forth in claim 1 in which the leaching of the reduced source is effected at a temperature in the range of from about ambient to about 110° C.

6. The process as set forth in claim 1 in which said hydrogen halide is hydrogen chloride.

* * * * *